US009956127B2

(12) United States Patent
Turner et al.

(10) Patent No.: US 9,956,127 B2
(45) Date of Patent: May 1, 2018

(54) OCCUPANT SUPPORT WITH A TRANSLATABLE AND PARALLEL TRANSLATABLE UPPER BODY SECTION

(71) Applicant: Hill-Rom Services, Inc., Batesville, IN (US)

(72) Inventors: Jonathan D. Turner, Dillsboro, IN (US); Richard H. Heimbrock, Cincinnati, OH (US); Joseph A. Ernst, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 917 days.

(21) Appl. No.: 14/024,858

(22) Filed: Sep. 12, 2013

(65) Prior Publication Data

US 2014/0013512 A1 Jan. 16, 2014

Related U.S. Application Data

(63) Continuation of application No. 12/618,256, filed on Nov. 13, 2009, now Pat. No. 8,555,438.

(Continued)

(51) Int. Cl.

*A47B 7/02* (2006.01)
*A61G 7/018* (2006.01)

(Continued)

(52) U.S. Cl.

CPC ..... *A61G 7/018* (2013.01); *A61G 7/015* (2013.01); *A47C 19/04* (2013.01); *A61G 2203/74* (2013.01)

(58) Field of Classification Search

CPC .... A61G 7/018; A61G 7/015; A61G 2203/74; A47C 17/76; A47C 17/58; A47C 19/04; A47D 7/00

(Continued)

(56) References Cited

U.S. PATENT DOCUMENTS 3,392,723 A 7/1968 Calvin
5,254,924 A 10/1993 Ogasawara (Continued)

FOREIGN PATENT DOCUMENTS

EP 1354539 A1 10/2003
EP 1413281 A1 4/2004

(Continued)

OTHER PUBLICATIONS

Response to the Examination Report for European Patent Application No. 09252578.1 entitled, "Anthropometrically Governed Occupant Support" of Hill-Rom Services, Inc. Accompanying the response includes set of amended claims filed with the European Patent Office dated Oct. 25, 2011.

(Continued)

*Primary Examiner* — David E Sosnowski
*Assistant Examiner* — Morgan McClure
(74) *Attorney, Agent, or Firm* — Barnes & Thornburg LLP

(57) ABSTRACT

An occupant support system for supporting an occupant comprises a frame, an articulable assembly which includes an upper body section, and a motion control system arranged to rotate the upper body section by an amount $\Delta\alpha$ relative to the frame, to translate the upper body section along the frame by an amount $\Delta CS$, and to translate the upper body section by an amount $\Delta BS$ in a direction parallel to the upper body section. Both $\Delta BS$ and $\Delta CS$ are a function of $\Delta\alpha$.

14 Claims, 13 Drawing Sheets

Related U.S. Application Data

(60) Provisional application No. 61/115,374, filed on Nov. 17, 2008.

(51) Int. Cl.
*A61G 7/015* (2006.01)
*A47C 19/04* (2006.01)

(58) Field of Classification Search
USPC ..... 5/613, 616–618
See application file for complete search history.

(56) References Cited

U.S. PATENT DOCUMENTS

| | | | | |
|---|---|---|---|---|
| 5,479,665 | A | 1/1996 | Cassidy et al. | |
| 5,544,376 | A | 8/1996 | Fromson | |
| 5,577,280 | A | 11/1996 | Elliott | |
| 5,640,730 | A | 6/1997 | Godette | |
| 5,870,784 | A | 2/1999 | Elliott | |
| 6,209,157 | B1 | 4/2001 | Hensley | |
| 6,347,420 | B2 | 2/2002 | Elliott | |
| 6,782,573 | B2 | 8/2004 | Odderson | |
| 6,957,458 | B2 | 10/2005 | Nagaoka | |
| 6,957,459 | B2 | 10/2005 | Nagaoka | |
| 7,036,166 | B2 | 5/2006 | Kramer | |
| 7,296,312 | B2 * | 11/2007 | Menkedick | A61B 5/1115 5/600 |
| 7,325,265 | B2 | 2/2008 | Hornbach | |
| 7,392,557 | B1 | 7/2008 | Kohlman | |
| 7,441,291 | B2 | 10/2008 | Hayes | |
| 7,454,805 | B2 * | 11/2008 | Osborne | A61G 7/005 5/600 |
| 7,464,422 | B2 | 12/2008 | Townsend | |
| 7,698,761 | B2 * | 4/2010 | Neuenswander | A47C 20/041 5/611 |
| 7,757,318 | B2 * | 7/2010 | Poulos | A61G 7/16 5/613 |
| 7,913,336 | B2 | 3/2011 | Morin | |
| 8,011,044 | B1 | 9/2011 | Jones | |
| 2002/0178502 | A1 | 12/2002 | Beasley | |
| 2005/0172398 | A1 | 8/2005 | Smith et al. | |
| 2006/0168731 | A1 | 8/2006 | Menkedick et al. | |
| 2008/0040861 | A1 | 2/2008 | Ootayopas | |
| 2008/0295248 | A1 | 12/2008 | Hayes | |
| 2009/0044339 | A1 | 2/2009 | Morin | |
| 2009/0094746 | A1 | 4/2009 | Ferraresi | |
| 2010/0122415 | A1 | 5/2010 | Turner et al. | |
| 2012/0174319 | A1 | 7/2012 | Menkedick et al. | |

FOREIGN PATENT DOCUMENTS

| | | | |
|---|---|---|---|
| EP | 1372433 | B1 | 11/2004 |
| EP | 2119421 | A1 | 11/2009 |
| WO | 2005007498 | A1 | 1/2005 |
| WO | 2007096828 | A1 | 8/2007 |

OTHER PUBLICATIONS

Communication pursuant to Article 94(3) EPC sent Dec. 12, 2011 from the European Patent Office for EP Application No. 09252578.1 entitled, "Anthropometrically Governed Occupant Support" of Hill-Rom Services, Inc.

Response to Communication pursuant to Article 94(3) EPC sent Dec. 12, 2011 from the European Patent Office for EP Application No. 09252578.1 entitled, "Anthropometrically Governed Occupant Support" of Hill-Rom Services, Inc. Accompanying the response includes set of amended claims filed with the European Patent Office.

European Search Report accompanied by Examiner's Preliminary Opinion, "Application No. EP 09252578", (dated Aug. 10, 2010), The Hague, total number of pp. 5.

Examination Notification Art. 94(3) dated Jul. 26, 2011 received for Application No. 09252578.1. European Patent Office, Postbus 5818, 2280 HV Rijswijk Netherlands.

* cited by examiner

OCCUPANT SUPPORT WITH A TRANSLATABLE AND PARALLEL TRANSLATABLE UPPER BODY SECTION

CROSS REFERENCE TO RELATED APPLICATIONS

This application claims priority to U.S. patent application Ser. No. 12/618,256 entitled "Anthropometrically Governed Occupant Support" filed on Nov. 13, 2009, which claims priority to Provisional Patent Application 61/115,374, Entitled "Anthropometrically Governed Occupant Support" filed on Nov. 17, 2008, the disclosures of both of which are expressly incorporated by reference herein.

TECHNICAL FIELD

The subject matter described herein relates to articulable supports, such as hospital beds, and particularly to a support whose articulation depends at least in part on anthropometric considerations.

BACKGROUND

Health care facilities use articulated beds, i.e. beds with segments connected together at joints so that the angular orientation of the segments and/or the positions of the segments can be changed. These beds, or the jointed segments thereof, are customarily referred to as "articulating" or "articulable". The term "articulation" is also routinely used to refer to the motion of the segments, for example rotational motion of the segments about the joint axes and translational motion of the segments.

Articulation of the bed can cause the occupant of the bed to migrate toward the foot end of the bed. The need to reposition the migrated occupant adds to the workload of the caregiver staff. Moreover, the physical demands of repositioning the occupant can cause injury to the caregiver. The articulation can also cause chafing and abrasion of the occupant's skin.

It is, therefore, desirable to regulate the articulation in a way that resists the tendency of the occupant to migrate toward the foot of the bed.

SUMMARY

An occupant support system for supporting an occupant comprises a frame, an articulable assembly which includes an upper body section, and a motion control system arranged to rotate the upper body section by an amount Au relative to the frame, to translate the upper body section along the frame by an amount ΔCS, and to translate the upper body section by an amount ΔBS in a direction parallel to the upper body section. Both ΔBS and ΔCS are a function of Δα.

The foregoing and other features of the occupant support described herein will become more apparent from the following detailed description and the accompanying drawings.

DETAILED DESCRIPTION

Figure 1A:
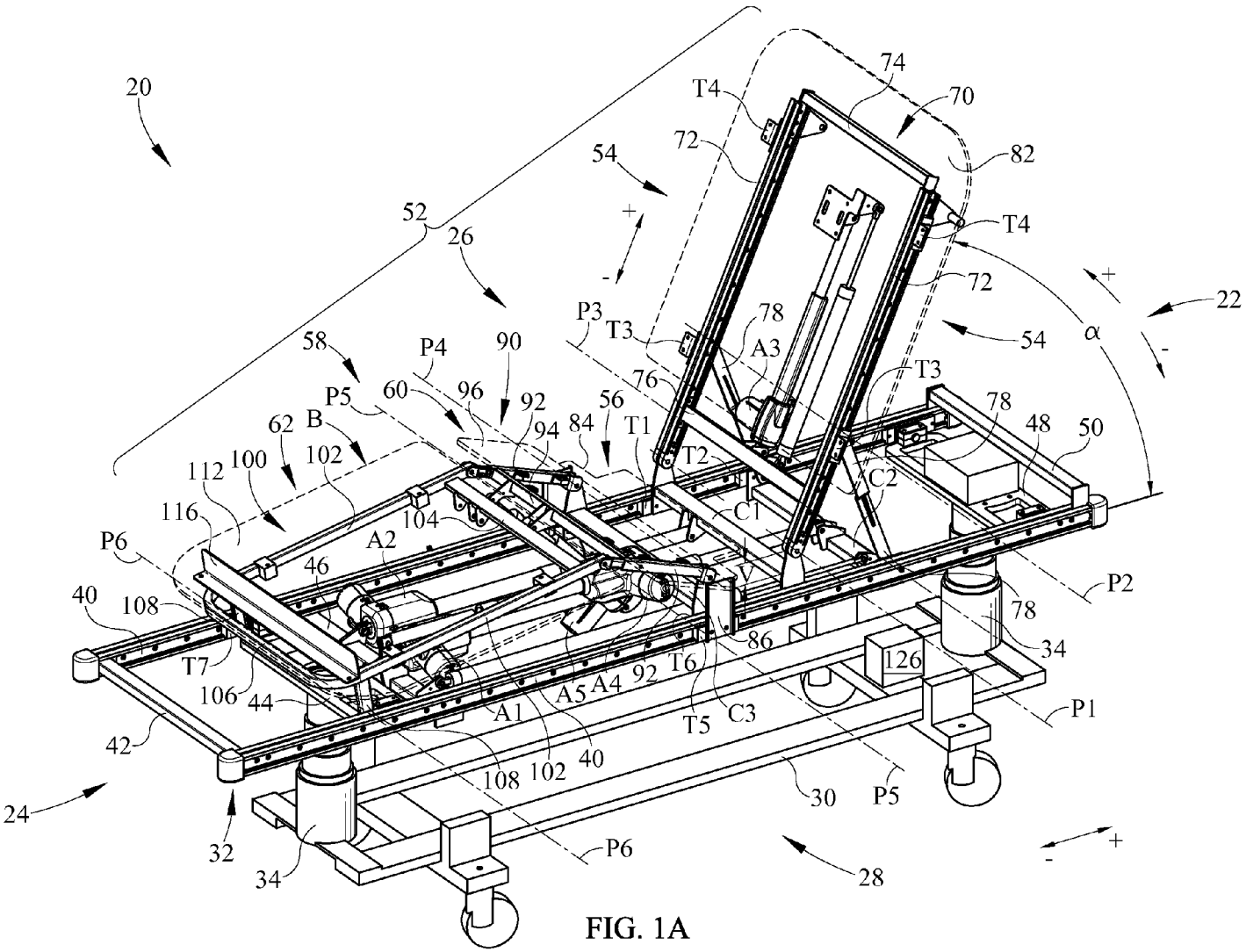
FIGS. 1A and 1B are a perspective view and a perspective partial view respectively of a prototype of an articulating bed as described herein.
Figure 1B:
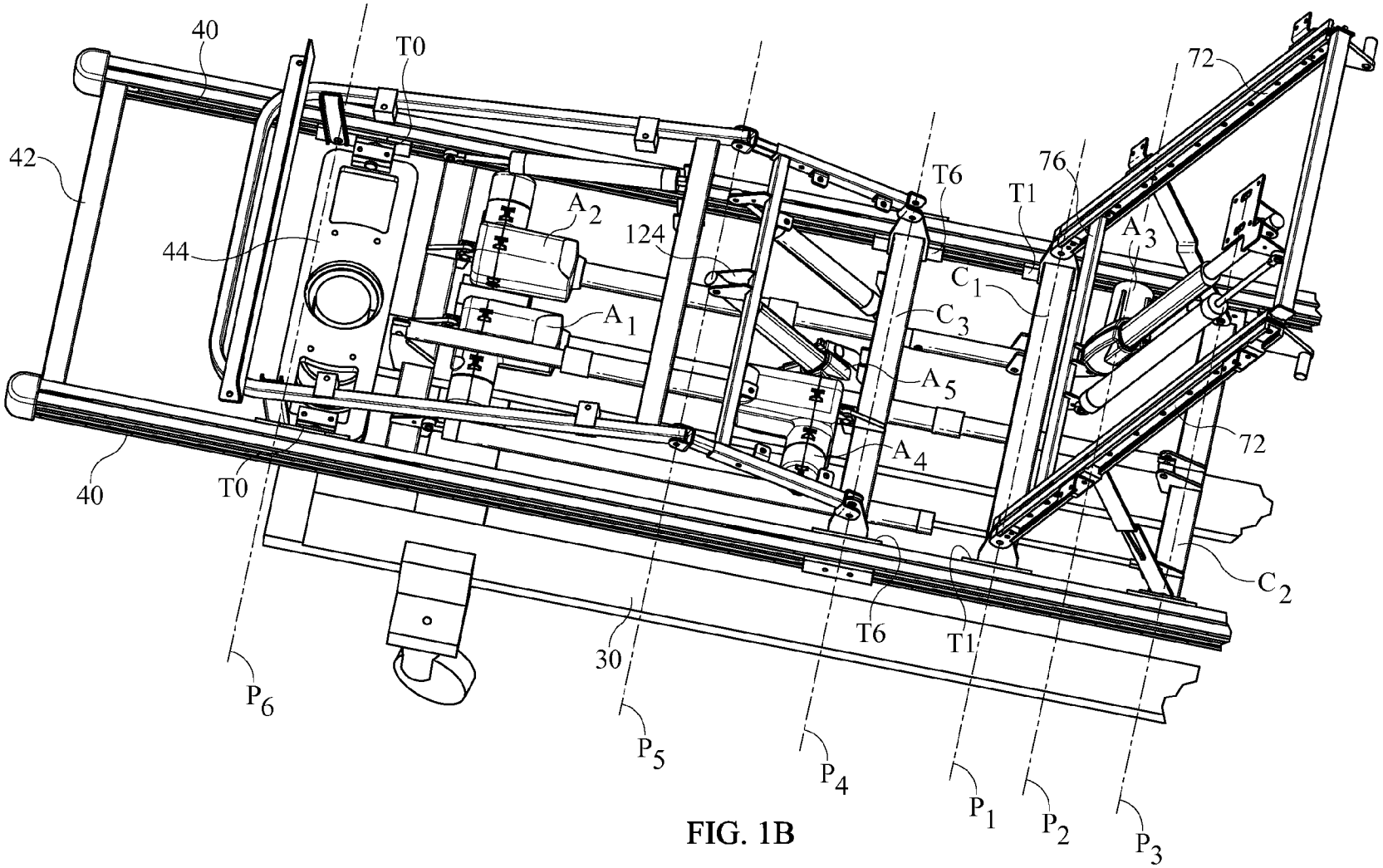

Referring to FIGS. 1A and 1B, a bed 20 has a head end 22, a foot end 24, a right side 26 and a left side 28. The terms "upper" and "lower" are used herein to signify that a feature of the bed is relatively closer to the head end or foot end respectively. The bed includes a base frame 30, and an upper frame 32 connected together by a lift mechanism such as canister lifts 34. The upper frame includes longitudinally extending rails 40 and cross members 42, 44, 46, 48 and 50 connected to the rails and extending laterally therebetween. The lifts 34 act on cross members 44, 48 to raise or lower the upper frame relative to the base frame. Cross members 42, 46, 48 and 50 are non-movably connected to the rails. Cross member 44 is connected to the rails by left and right trolleys T0 that allow the member 44 to translate longitudinally along the rails. The translatability of member 44 relative to member 48 accommodates unequal vertical extension of the lift mechanisms necessary to incline the upper frame to a Trendelenburg or reverse Trendelenburg orientation. The trolleys T0, like all the trolleys referred to herein, are longitudinally translatable along a rail. The trolleys may be constructed in any suitable way. For example a trolley may have wheels that roll along the rail. Alternatively, a trolley may be constructed to simply slide along the rail, the sliding preferably being assisted by appropriate use of a low friction material on the trolley and/or rail. Because each trolley is paired with a laterally opposite trolley, only a single reference symbol (e.g. T0) is used to refer to both trolleys.

The bed also includes an articulable assembly 52 comprising three principal sections: an upper body section 54, a seat section 56, and a leg section 58. The leg section comprises a thigh section 60 and a calf section 62.

The upper body section 54 includes an upper body frame 70 comprising upper body lateral rails (i.e. left and right rails 72) non-movably connected to an upper beam 74 and a lower beam 76. The lateral rails are also connected to a first carriage C1 at pivot joints that define a first pivot axis P1.

The carriage spans laterally between the rails 40 of the upper frame and includes left and right trolleys T1 for translatably connecting the carriage to the rails 40.

Compression links 78 are connected to the upper body rails 72 at pivot joints that define a second pivot axis P2. The other end of each compression link is connected to a second carriage C2 at pivot joints that define a third pivot axis P3. Trolleys T2 translatably connect the second carriage to the upper frame rails 40. Trolleys T3 and T4 translatably connect an upper body deck panel 82 to the upper body rails 72.

The seat section 56 of the bed includes a seat deck panel 84 translatably connected to the upper frame rails 40 by way of connectors 86 and trolleys T5. Trolleys T5, unlike the other trolleys referred to herein, ride along the outboard side of each upper frame rail 40 rather than along the inboard side.

The thigh section 60 includes a thigh section frame 90 comprising lateral beams (i.e. left and right beams 92) and a lower beam 94 extending laterally between the left and right beams. In the illustrated construction, the lateral beams are welded to the lower beam. The upper ends of the lateral beams 92 are connected to a third carriage C3 at pivot joints that define a fourth pivot axis P4. A sixth trolley T6 translatably connects the carriage C3 to the upper frame rails 40. A thigh deck panel 96 is nonmovably connected to the thigh frame 90

The calf section 62 includes a calf section frame 100 comprising lateral beams (i.e. left and right beams 102) an upper beam 104 and a lower beam 106. The upper and lower beams extend laterally between the left and right beams. In the illustrated construction, the lateral beams 102 and lower beam 106 are a single part, and the upper beam is a separate part welded to lateral beams 102 near their upper ends. The upper end of each lateral beam 102 is connected to the lower end of the corresponding thigh beams 92 at a pivot joint. The pivot joints define a fifth pivot axis P5. A link 108 is non-pivotably connected to each beam 102 near the lower end of the beam. The other end of each link 108 is connected to a seventh trolley T7 at a pivot joint, the pivot joints defining a sixth pivot axis P6. A calf deck panel 112 is non-movably secured to the calf frame 100. A mattress retainer 116 spans laterally across the calf deck.

Each section of the illustrated articulable assembly 52 is capable of at least one of several modes of motion. The upper body section 54 is translatable along the upper frame rails 40 in a positive or headward direction (toward the head end of the bed) and a negative or footward direction (toward the foot end of the bed). The upper body frame 70 and deck 82 are also pivotable about axis P1 so that the upper body deck forms a variable angle $\alpha$ with the upper frame rails. Rotation about axis P1 that pivots the upper body section away from upper frame 32 and increases $\alpha$ is positive rotation whereas rotation that pivots the upper body section toward the upper body frame and decreases $\alpha$ is negative rotation. The upper body deck 82 is also slidable relative to the frame 70 in a direction parallel to the existing orientation of the upper body section. This motion is referred to herein as "parallel translation" to distinguish it from translation of the upper body section along the upper frame rails 40. Positive parallel translation is translation toward the head or upper end of the upper body frame whereas negative parallel translation is translation toward the foot or lower end of the upper body frame.

The seat section 56 is capable of headward and footward translation along the upper frame rails 40.

The leg section 58, which comprises the thigh and calf sections 60, 62, is headwardly (positively) and footwardly (negatively) translatable along the rails 40. The thigh and calf sections are also individually pivotable about pivot axes P4 and P6 respectively. Rotations that pivot the thigh and calf sections away from the upper frame and decrease the angle $\beta$ between the thigh and calf decks are positive rotations. Rotations that pivot the thigh and calf sections toward the upper frame and increase the angle $\beta$ between the thigh and calf decks are negative rotations.

Collectively, deck panels 82, 84, 96, 112 define a deck 120. As seen schematically in FIG. 2, the articulable assembly includes a mattress 122 resting atop the deck. The mattress is removably secured to the deck by suitable means, such as by hook and loop fasteners affixed to the mattress and to deck panels 82, 96, 112. The mattress retainer 116 helps prevent the mattress from sliding off the foot end of the deck. Because of the articulating nature of the deck, the mattress is required to have the ability to stretch longitudinally in response to relative movement of the deck sections.

The bed also includes a suite of actuators. A first actuator A1 extends from upper frame cross member 46 to the second carriage C2. A second actuator A2 extends from the same cross member to the first carriage C1. Equal extension or retraction of actuators A1 and A2 moves carriages C2 and C1 to translate the upper body section 54 headwardly or footwardly respectively. Unequal extension or retraction (including extension of one actuator and retraction of the other) will cause, in addition to translation, rotation of the upper body section about axis P1. The limit case in which the extension or retraction is unequal because one of the actuators A1, A2 is not extended or retracted at all will cause rotation about P1 but no translation.

A third actuator A3 is secured at its lower end to the lower beam 76 of the upper body frame and at its upper end to the upper body deck 82. Extension of the third actuator causes positive parallel translation of the upper body section deck; retraction of actuator A3 causes negative parallel translation.

A fourth actuator A4 is secured at its lower end to the cross member 46 that hosts the lower ends of actuators A1 and A2 and at its upper end to carriage C3. Extension or retraction of actuator A4 moves carriage C3. Trolleys T7 move the same distance as the trolleys T6 to which carriage C3 is attached. As a result the leg section 58 translates headwardly or footwardly with no change in the angular orientation of the thigh and calf frames and decks.

A fifth actuator A5 is secured at its upper end to carriage C3 and at its lower end to a bracket 124 projecting from the thigh section frame. Extension of actuator A5 rotates the thigh frame in the positive direction about axis P4. Because the thigh and calf frames are connected at the pivot joints that define axis P5, the extension of the actuator A5 also rotates the calf frame in a positive direction about axis P6, reducing the angle $\beta$ (FIG. 2) and translating trolleys T7 toward trolleys T6 irrespective of whether trolley T6 is translating or not.

The various actuators govern the motions of all the sections except for the seat section 56. The seat section translates headwardly and footwardly in response to the longitudinal stretching or relaxation of the mattress that takes place as a consequence of movement of the other sections 54, 60, 62. As the mattress stretches and relaxes, it drags the seat deck panel causing the seat section to translate.

The bed also includes a processor 126 indicated schematically in FIG. 1A for processing control laws that direct the operation of the actuators.

Figure 3:
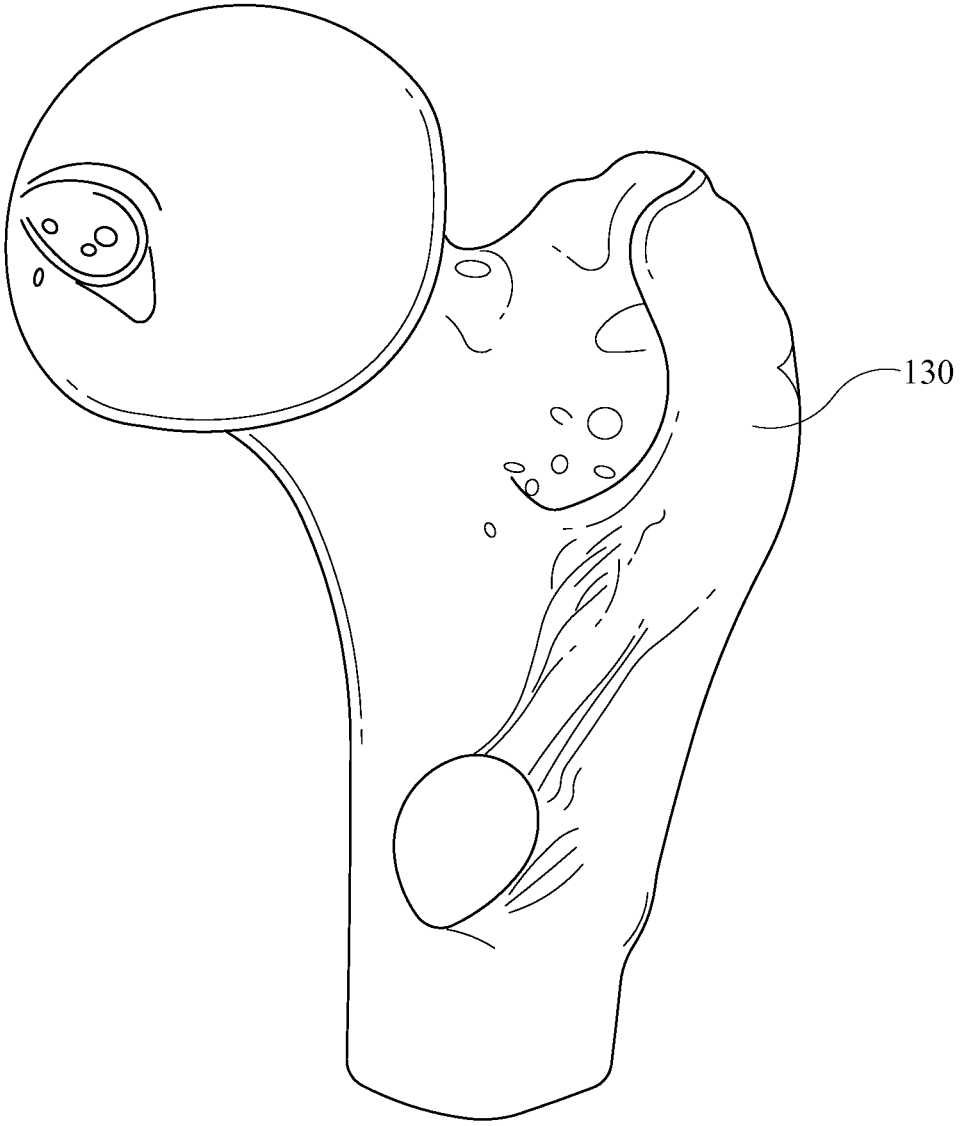
FIG. 3 is a view illustrating the greater trochanter of the human thigh.

Collectively, the control laws processed by the processor 126, and the kinematic linkages including the actuators, comprise a motion control system. The motion control system is configured to control the motion of the articulating assembly 52 based on anthropometric considerations. Of particular interest is an occupant's greater trochanter 130, which is the bony lateral protrusion of the proximal end of the femur as seen in FIG. 3. The left and right trochanters define a leg pivot axis 132 as seen in FIG. 4.

The motion control system controls the motion of the articulating sections as the sections move between a starting configuration at which the occupant's trochanter is at a starting spatial location relative to the articulable assembly and an end configuration at which the occupant's trochanter is at an ending spatial location. In particular, in order to resist occupant migration toward the foot of the bed, the motion control system controls the motion such that upon return of the bed to the starting configuration the occupant's trochanter point is at a spatial location substantially the same as the starting spatial location. In the limit, the occupant's trochanter remains at substantially the same spatial location during the motion from the starting configuration to the end configuration and back again. Such a result is not achieved with pre-existing beds because of occupant migration that occurs as a result of bed articulation.

Figure 4:
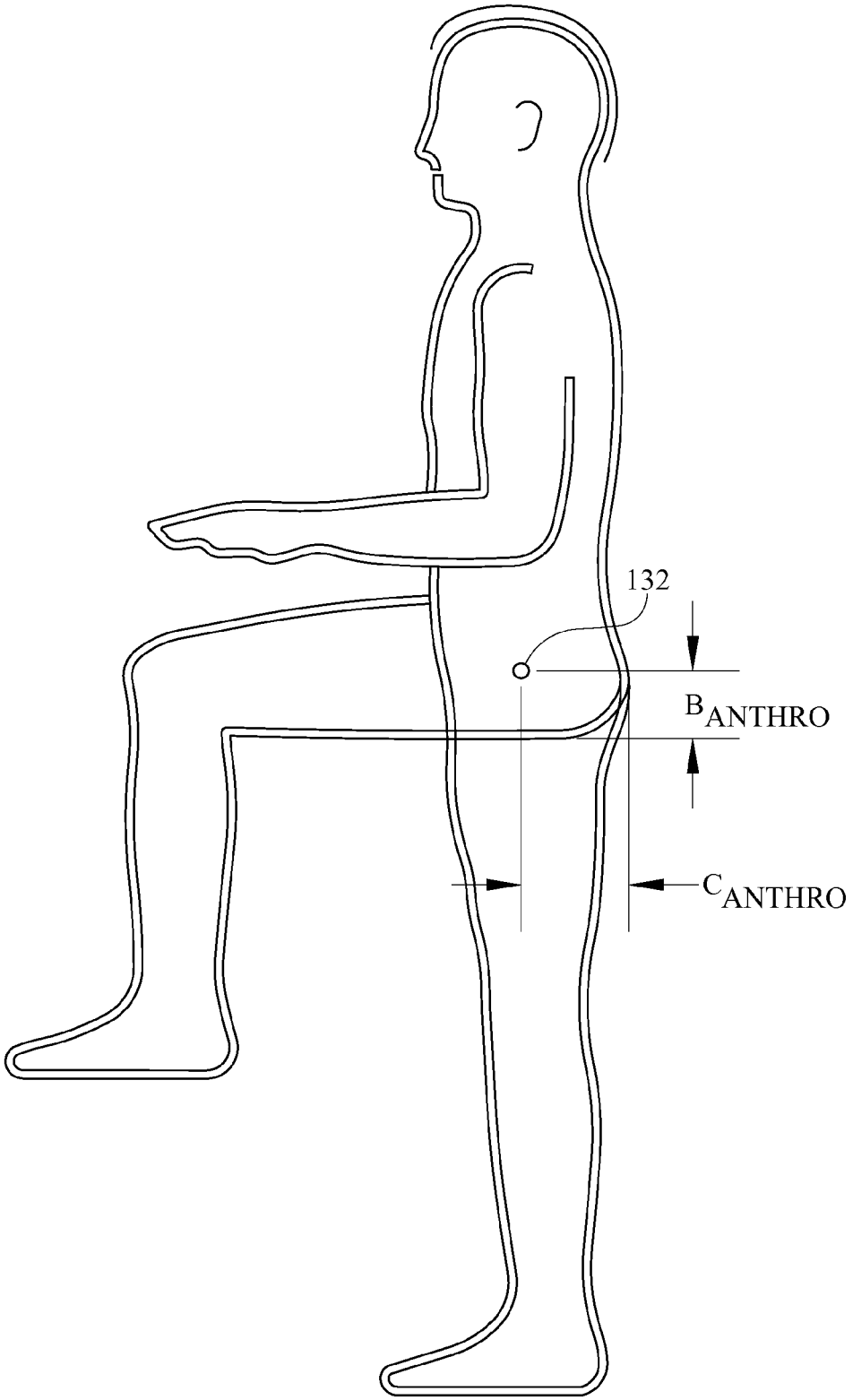
FIG. 4 is a schematic, side elevation view showing a human profile and certain dimensions referred to herein.

A mode of articulation that resists the tendency for the occupant to migrate toward the foot of the bed may be understood by considering the anthropometric dimensions $B_{ANTHRO}$ and $C_{ANTHRO}$ seen in FIG. 4. Dimension $B_{ANTHRO}$ is the distance from the trochanter axis 132 of the intended bed occupant to the bottom of the occupant's thigh when the thigh and upper body are oriented approximately 90 degrees to each other as seen in FIG. 4. Dimension $C_{ANTHRO}$ is the distance from the trochanter axis 132 of the intended occupant to the surface of the occupant's buttocks as also shown in FIG. 4. The ratio $B_{ANTHRO}/C_{ANTHRO}$ is referred to herein as the anthropometric ratio. The motion control system is configured so that during operation of the bed, positive rotation of the upper body section 54 is accompanied by headward (positive) translation of the upper body section and positive parallel translation of the upper body deck panel 82. Conversely, negative rotation of the upper body section 54 is accompanied by footward (negative) translation of the upper body section and negative parallel translation of the upper deck panel 82. The amount of translation and parallel translation required to resist occupant migration for a given amount of rotation $\Delta\alpha$ of upper body section 54 are a function of anthropometric characteristics. In particular, the upper body section 54 is translated by a scheduled amount $\Delta C_S$ in the direction described above while the deck panel 82 undergoes a scheduled parallel translation of $\Delta B_S$ in the direction described above. The magnitude of the translation and parallel translation are, in general, not the same for different occupants, e.g. light weight and heavy weight occupants or occupants having different morphology.

Figure 5:
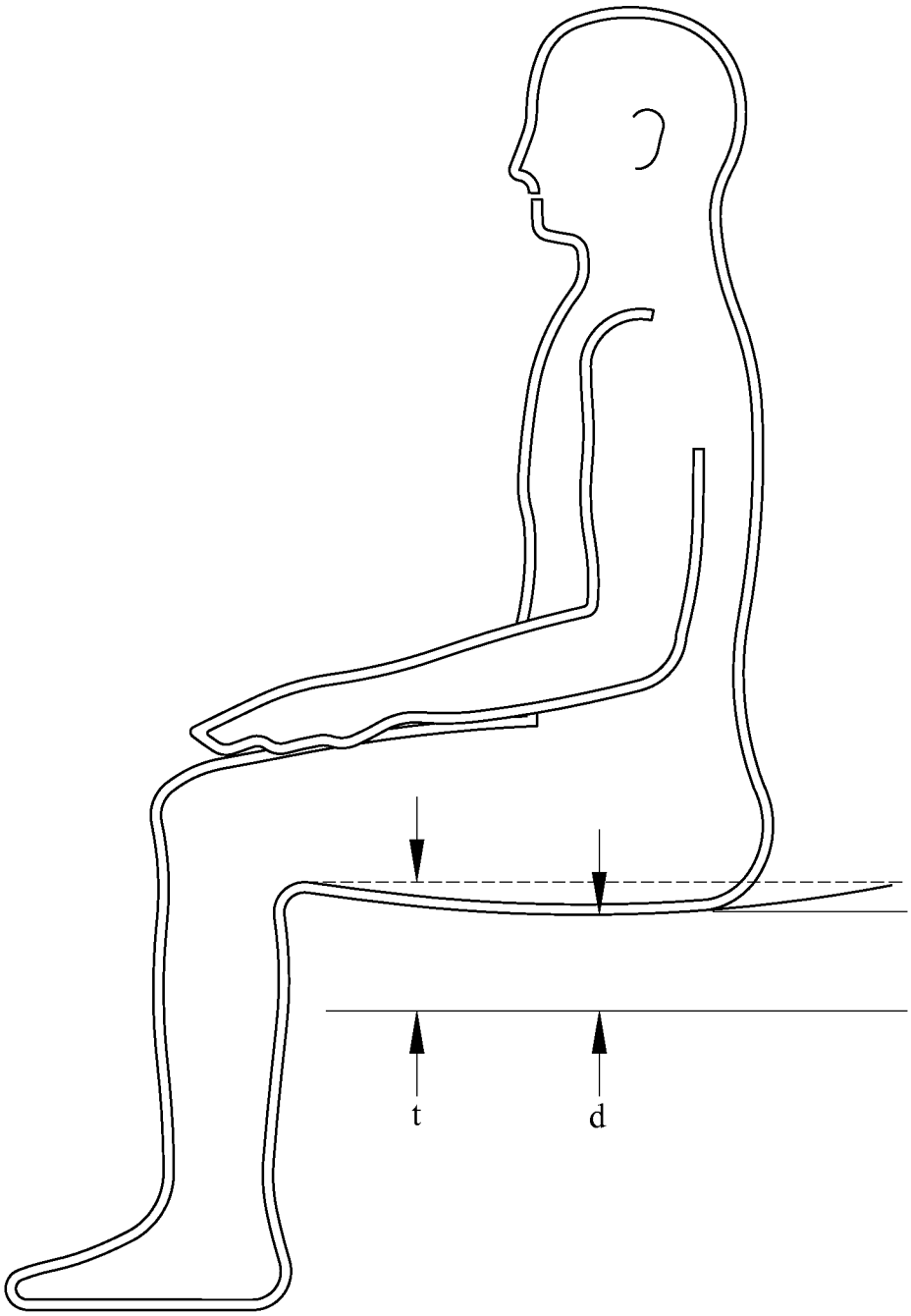
FIG. 5 is a side elevation view showing deflection of a mattress due to the presence of an occupant.
Figure 6:
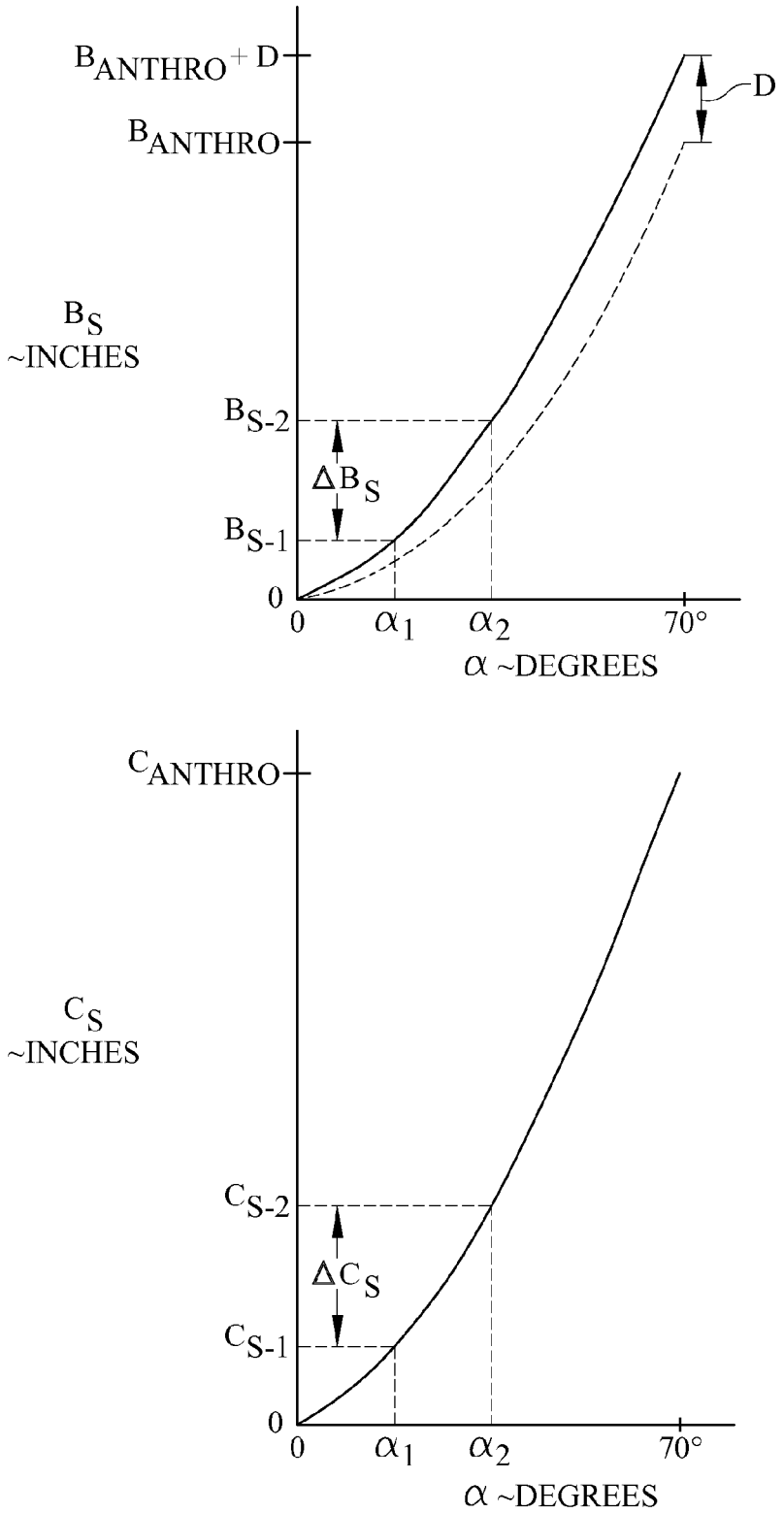
FIG. 6 is a pair of graphs showing anthropometrically satisfactory scheduled articulations of an articulable assembly of the bed of FIGS. 1A and 1B.

The scheduled parallel translation $\Delta B_S$ is determined from the relationship of FIG. 6 which shows $B_S$ as a function of $\alpha$. The relationship passes through coordinates (0,0) and (70°, $B_{ANTHRO}$+D) and has a shape governed by the kinematics of the motion control actuators and linkages. Because $B_{ANTHRO}$ is different for different occupants, the relationship of FIG. 6 can be viewed as a multiplicity or family of relationships. Offset distance D depends on $\alpha$ and on the distance d from the occupant's buttocks to the upper body deck panel as determined when the occupant is seated on a mattress and the occupant's upper body and thighs form an approximately 90 degree angle as seen in FIG. 5. This approximately 90° posture typically results when the upper frame is at an angle of less than 90 degrees and depends on the properties of the mattress. With the mattress used in applicants' studies, the 90 degree posture of the occupant occurs at $\alpha$ equal to approximately 70°. Distance d depends on the characteristics of the occupant such as weight and morphology and on characteristics of the mattress such as the undeflected thickness t and indention load deflection of the mattress. The distance D may also depend on certain geometric features of the bed such as the vertical distance V (FIG. 1) by which the elevation of pivot axis P1 exceeds the elevation of the surface that contacts and supports the mattress, for example the surface of the seat deck panel 84. Accordingly, the magnitude of the scheduled parallel translation $\Delta B_S$ associated with a change in angular orientation $\Delta\alpha$ of the upper body section from $\alpha_1$ to $\alpha_2$ is given by the relationship:

$$\Delta B_S = |(B_S)_1 - (B_S)_2| \quad (1)$$

The scheduled translation $\Delta C_S$ of the upper body section is determined from the relationship of FIG. 6 which shows $C_S$ as a function of $\alpha$. The relationship passes through coordinates (0,0) and (70°, $C_{ANTHRO}$) and has a shape governed by the kinematics of the motion control actuators and linkages. Because $C_{ANTHRO}$ is different for different occupants, the relationship of FIG. 6 can be viewed as a family or multiplicity of relationships. The magnitude of the scheduled parallel translation $\Delta C_S$ associated with a change in angular orientation $\Delta\alpha$ of the upper body section from $\alpha_1$ to $\alpha_2$ is given by the relationship:

$$\Delta C_S = |(C_S)_1 - (C_S)_2| \quad (2)$$

To summarize the foregoing, if the upper body section is at an initial orientation $\alpha_1$ and it is desired to change the orientation to $\alpha_2$, the upper body deck panel will be commanded to undergo a positive parallel translation of $\Delta B_S$ and the upper body section will be commanded to undergo a positive (headward) translation of $\Delta C_S$. It may also be desirable to adjust the angle $\beta$ between the thigh and calf sections to provide appropriate patient comfort including heel pressure relief.

Figure 7:
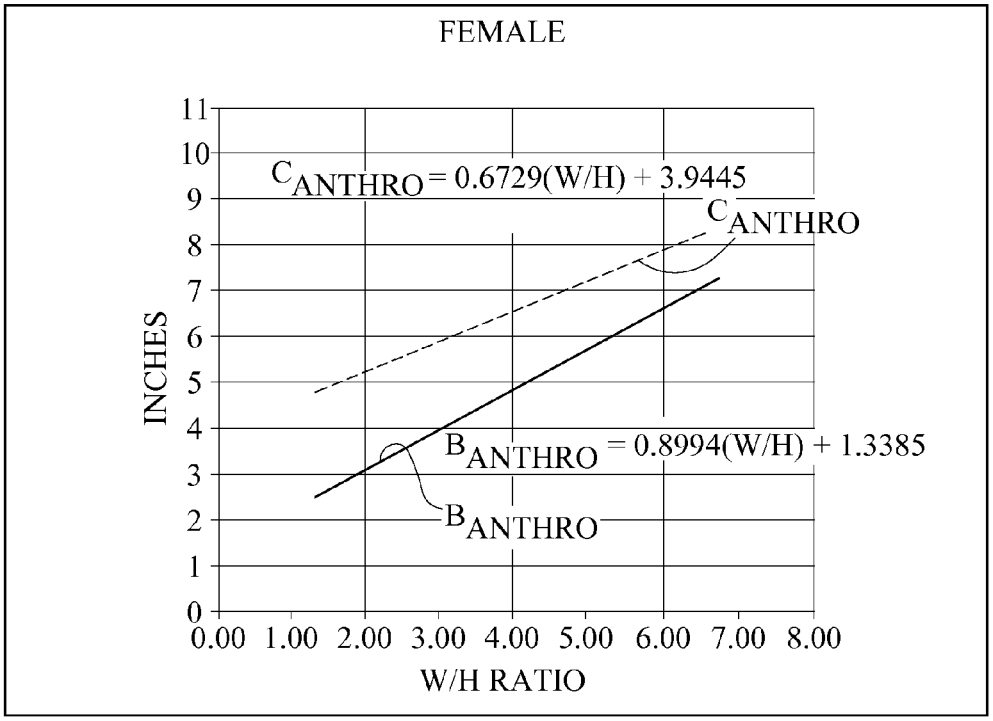
FIG. 7 is a graph showing a relationship between the dimensions of FIG. 4 and the ratio of weight to height for a human female.
Figure 8:
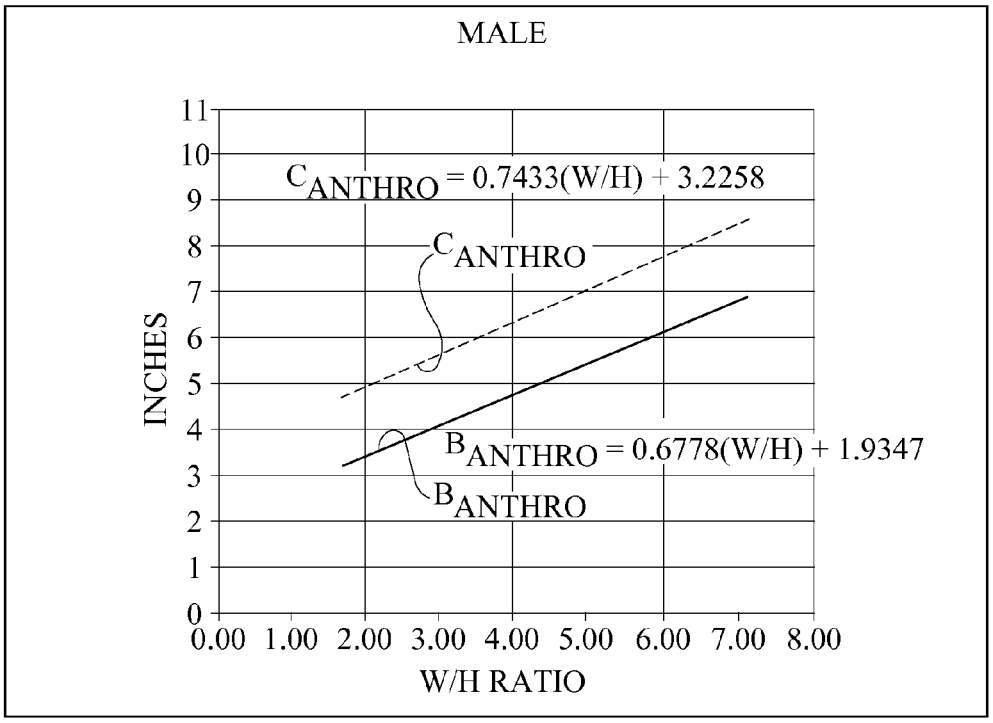
FIG. 8 is a graph showing a relationship between the dimensions of FIG. 4 and the ratio of weight to height for a human male.

Applicants have determined that dimensions $B_{ANTHRO}$ and $C_{ANTHRO}$ can be satisfactorily estimated as a function of an occupant's weight to height ratio W/H expressed in pounds per inch as shown in FIG. 7 for a female occupant and FIG. 8 for a male occupant. The relationships of FIGS. 7 and 8 are linear relationships through two sets of data points, one set taken from "The Measure of Man and Woman—Human Factors in Design" by Alvin R. Tilley, ISBN 0-471-09955-4 and the other set taken from bariatric subjects studied by the assignee of the present application. Although FIGS. 7 and 8 show $B_{ANTHRO}$ and $C_{ANTHRO}$ as functions of gender and the W/H ratio, other factors may also be taken into consideration. These include inter-individual factors such as race and ethnicity, and intra-individual factors such as pregnancy, and missing or abnormally shaped limbs.

In general, different occupants will exhibit different values of $B_{ANTHRO}$ and $C_{ANTHRO}$ and will therefore require different translations $\Delta C_S$ and parallel translations $\Delta B_S$ to experience satisfactory anthropometric performance when the upper body section is rotated from $\alpha_1$ to $\alpha_2$. In other words, the anthropometric values $B_{ANTHRO}$ and $C_{ANTHRO}$ and the anthropometric ratio $B_{ANTHRO}/C_{ANTHRO}$ are not the same for all occupants, and therefore the values $\Delta B_S$ and $\Delta C_S$ are also not the same for all occupants. However the mechanical components required to provide occupant specific customization of $\Delta B_S$ and $\Delta C_S$ will be more complex, bulkier, heavier, more expensive and less reliable than those for providing fixed values of $\Delta B_S$ and $\Delta C_S$ (and a fixed value of the ratio $\Delta B_S/\Delta C_S$) for any given initial value of $\alpha$. Good reliability is highly desirable when the motion control system is designed to provide a Cardio-Pulmonary Resuscitation (CPR) feature which places the articulable frame panels in a level and flat configuration in response to a single, simple input, e.g. pressure exerted on a push button or a pedal. Therefore, it may be advisable to arrange the kinematics to provide a constant $\Delta B_S/\Delta C_S$ ratio or at least a $\Delta B_S/\Delta C_S$ ratio that is fixed for any given initial value of $\alpha$, thereby achieving the best possible reliability of the CPR feature in return for some sacrifice in anthropometric performance.

Figure 9A:
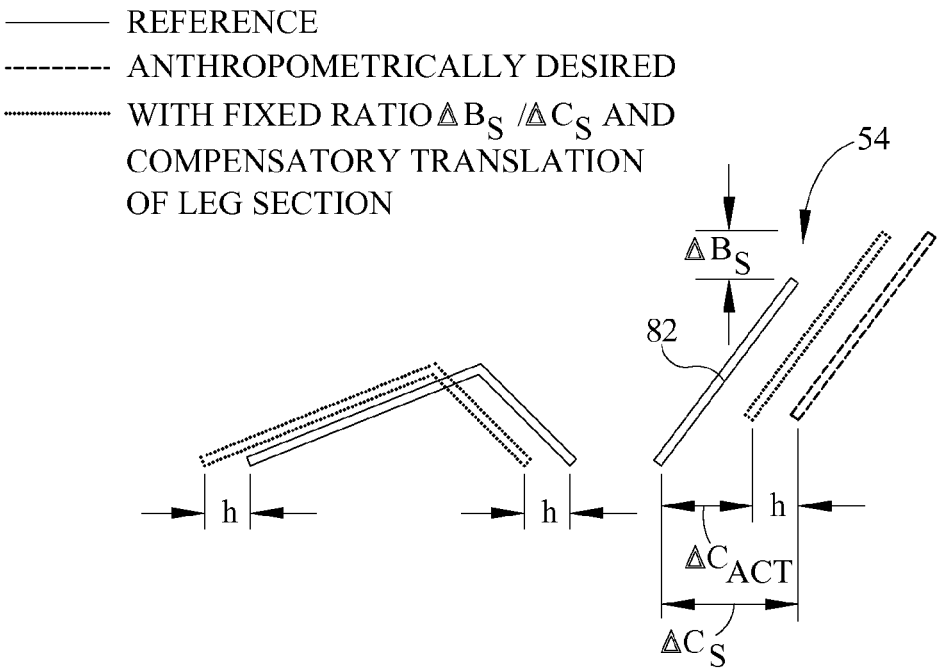
FIGS. 9A and 9B are schematic, side elevation views depicting the upper body and leg sections of an articulating bed and showing a compensatory articulation of the leg section.
Figure 9B:
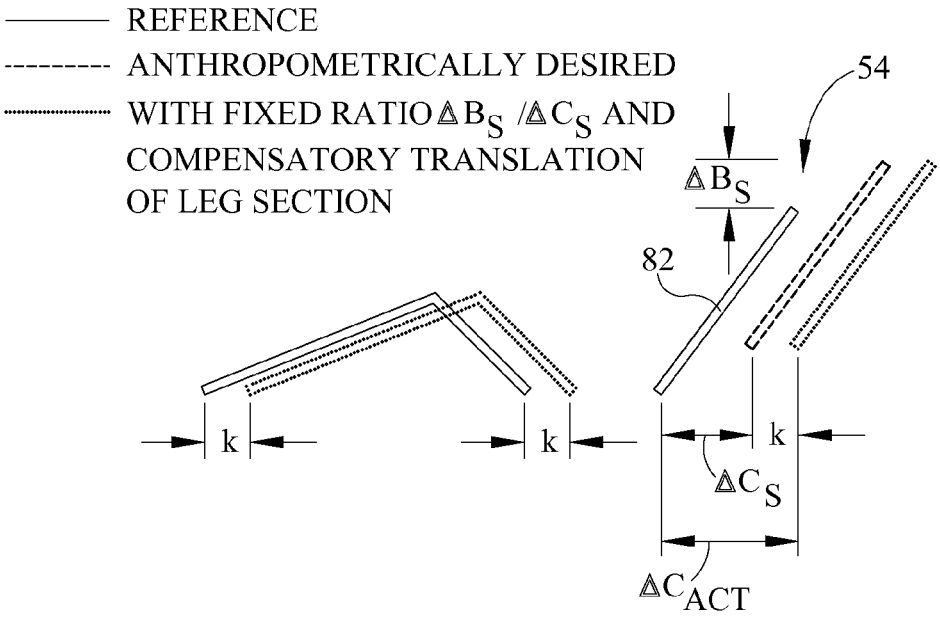

Referring to FIGS. 9A and 9B, the above mentioned sacrifice of anthropometric performance can, if desired, be at least partly mitigated by a compensatory translation of the leg section. FIGS. 9A and 9B depict three post-rotation configurations of the bed, i.e. positions of the upper body section and leg section subsequent to pivoting of the upper body section in the positive direction. These configurations are: a reference configuration corresponding to the absence of translation and parallel translation of the upper body section (solid lines), an anthropometrically desired configuration (dashed lines), and a configuration that employs a compensatory translation of the leg section to counteract the nonanthropometric consequences of fixed $B_S/C_S$ ratio kinematics (dotted lines). For example, referring to FIG. 9A, if the anthropometrically desired parallel translation of the upper body deck panel 82 for a known occupant undergoing an angular change $\Delta\alpha$ is $\Delta B_S$, and the anthropometrically desired translation of the upper body section 54 for that occupant is $\Delta C_S$, but the actual scheduled translation $\Delta C_{ACT}$ delivered by a fixed ratio kinematic system is less than $\Delta C_S$ by a distance h, then the leg section will be commanded to undergo a compensatory negative translation of h. The shortfall h in positive translation of the upper body section means that, in the absence of some other action, the occupant's torso would be too close to his feet to be anthropometrically satisfactory. The compensatory negative translation h of the leg section compensates for the shortfall. Conversely, as seen in FIG. 9B, if the fixed ratio kinematic system causes the actual translation $\Delta C_{ACT}$ of the upper body section to exceed the anthropometrically desired translation $\Delta C_S$ by a distance k, then the leg section will be commanded to undergo a compensatory positive translation of k. In this case, the excess positive translation k of the upper body section means that, in the absence of some other action, the occupant's torso would be too distant from his feet to be anthropometrically satisfactory. The compensatory positive translation of k compensates for the excess.

A simple implementation of the foregoing involves developing a profile of a "standard occupant" using anthropometric statistics, preferably statistics representative of a target population of individuals. The anthropometric characteristics of the standard occupant are used by a designer to design the motion control system so that the system governs the movement of the articulable frame elements (the translation of the upper body section, parallel translation of the upper body deck panel and any compensatory translation of the leg section) in a way that is anthropometrically satisfactory for the standard occupant. The motions thus delivered by the motion control system are neither occupant specific nor "field configurable" by a typical caregiver or occupant. In other words, there is only a single functional relationship between the motion delivered by the motion control system and the anthropometric information used by the designer.

Such a "one size fits all" approach will, of course, be suboptimal for most occupants, but will nevertheless be superior to nonanthropometric designs.

Figure 10:
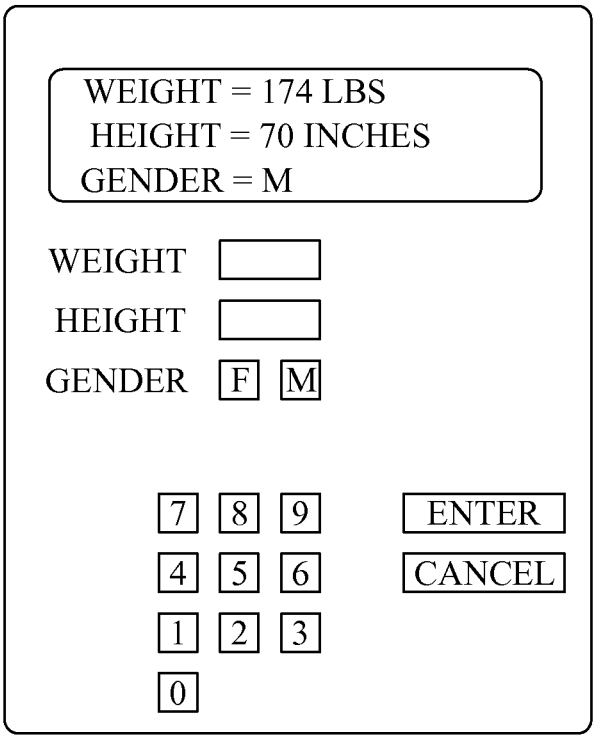
FIG. 10 is an example user interface for the articulating bed described herein.

A more sophisticated approach allows a user, typically a caregiver in a health care setting, to manually provide anthropometric inputs to the controller. For example, as seen in FIG. 10, a local or non-local keypad allows a user to inform the controller of the height, weight and gender of an occupant. The controller calculates the weight/height (W/H) ratio and, using the relationships of either FIG. 7 for a female occupant or of FIG. 8 for a male occupant, determines the values for $B_{ANTHRO}$ and $C_{ANTHRO}$ used in FIG. 6. These relationships can be expressed in any suitable form, for example as univariate or bivariate table lookups or as equations. Linear equations corresponding to the relationships of FIGS. 8 and 9 are set forth below:

$$B_{ANTHRO\text{-}FEMALE}=0.8994(W/H)+1.3385$$

$$C_{ANTHRO\text{-}FEMALE}=0.6729(W/H)+3.9445$$

$$B_{ANTHRO\text{-}MALE}=0.6778(W/H)+1.9347$$

$$C_{ANTHRO\text{-}MALE}=0.7433(W/H)+3.2258$$

Applicants have also observed that the data samples upon which the above equations are based exhibit greater scatter for occupants having a higher W/H ratio and less scatter for occupants having a low W/H ratio. Accordingly, it may be desirable to use two sets of equations, one for occupants whose W/H exceeds 3.5 and another for occupants whose W/H is no greater than 3.5, as set forth below:

$$B_{ANTHRO\text{-}FEMALE}=0.66(W/H)+1.80\ (W/H\ 3.5)$$

$$C_{ANTHRO\text{-}FEMALE}=0.55(W/H)+4.13\ (W/H\ 3.5)$$

$$B_{ANTHRO\text{-}MALE}=0.48(W/H)+2.21\ (W/H\ 3.5)$$

$$C_{ANTHRO\text{-}MALE}=0.63(W/H)+3.27\ (W/H\ 3.5)$$

$$B_{ANTHRO\text{-}FEMALE}=0.80(W/H)+1.88\ (W/H>3.5)$$

$$C_{ANTHRO\text{-}FEMALE}=0.42(W/H)+5.39\ (W/H>3.5)$$

$$B_{ANTHRO\text{-}MALE}=0.27(W/H)+4.25\ (W/H>3.5)$$

$$C_{ANTHRO\text{-}MALE}=0.26(W/H)+5.99\ (W/H>3.5)$$

It is evident that the exact relationships can be chosen based on any data and curve fitting accuracy satisfactory to the designer.

As already noted, the control laws can be written to account for other inter-individual and intra-individual characteristics, and the user interface can be correspondingly designed to accept relevant inputs.

Figure 11:
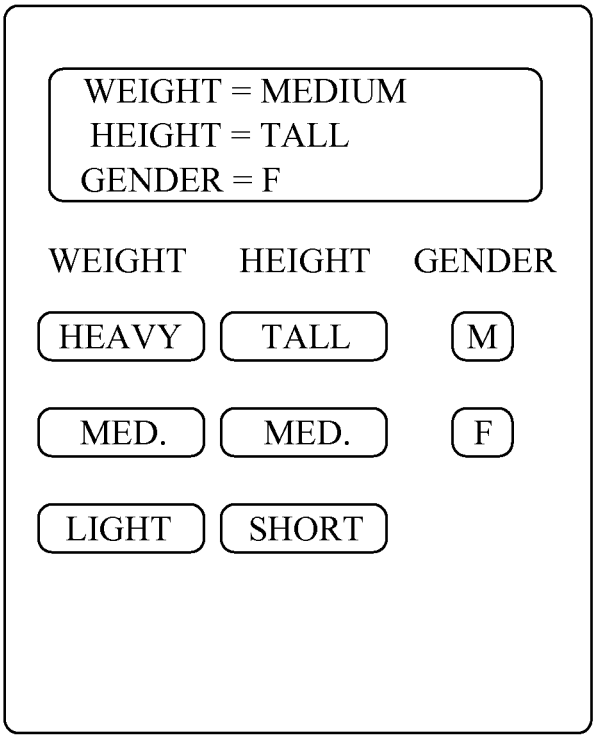
FIG. 11 is an alternative example user interface for the articulating bed described herein.

A variant on the immediately preceding approach involves control laws that use more subjective indicia of an occupant's anthropometric characteristics (and an associated user interface (FIG. 11) that accepts such indicia as inputs). For example, an occupant might be simply characterized as heavy, medium or light in weight and tall, medium or short in stature, with or without an indication of gender in order to estimate $B_{ANTHRO}$ and $C_{ANTHRO}$.

Local or non-local resources can be used to automatically acquire some or all of the input data used by the control laws. For example, the relevant data might be on record in a non-local database. If so, the data can be conveyed to the bed through a facility communication network. Alternatively, systems on board the bed can be used. For example, patient weight is readily available on beds designed with a built-in scale and an occupant's height can be determined with pressure sensors installed in or on the mattress. Hybrid approaches using combinations of data acquired manually or automatically from local or remote sources are also envisioned.

With the structure and function of the bed having now been described, certain variations can now be better appreciated.

Figure 12:
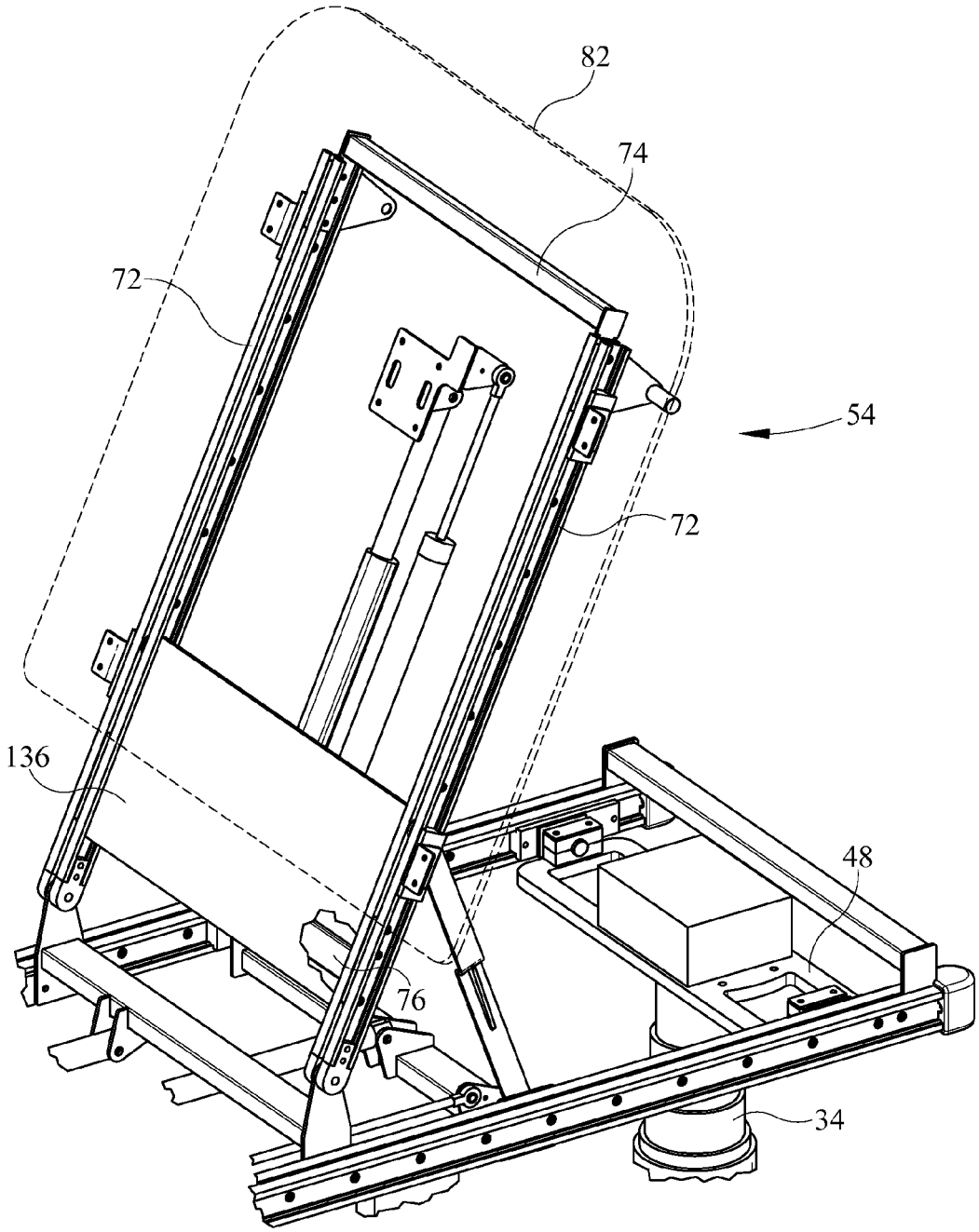
FIG. 12 is a perspective view of a portion of the head section of the bed of FIGS. 1A and 1B showing an auxiliary deck panel.

Referring to FIG. 12, the upper body section may be constructed with an auxiliary support deck 136 non-movably affixed to the upper body frame. In operation, positive parallel translation of the upper body deck panel 82 uncovers the auxiliary panel 136, which provides support for the mattress.

Although the disclosed bed includes three principal sections 54, 56 and 58, occupant migration toward the foot of the bed can, in principle, be mitigated without the use of the seat section 56, i.e. with only the upper body section 54 and, if it is desired to provide the above described compensatory translation, the translatable leg section 58. It will be necessary, of course, to ensure that the mattress receives adequate vertical support despite the absence of the illustrated seat section.

Figure 2:
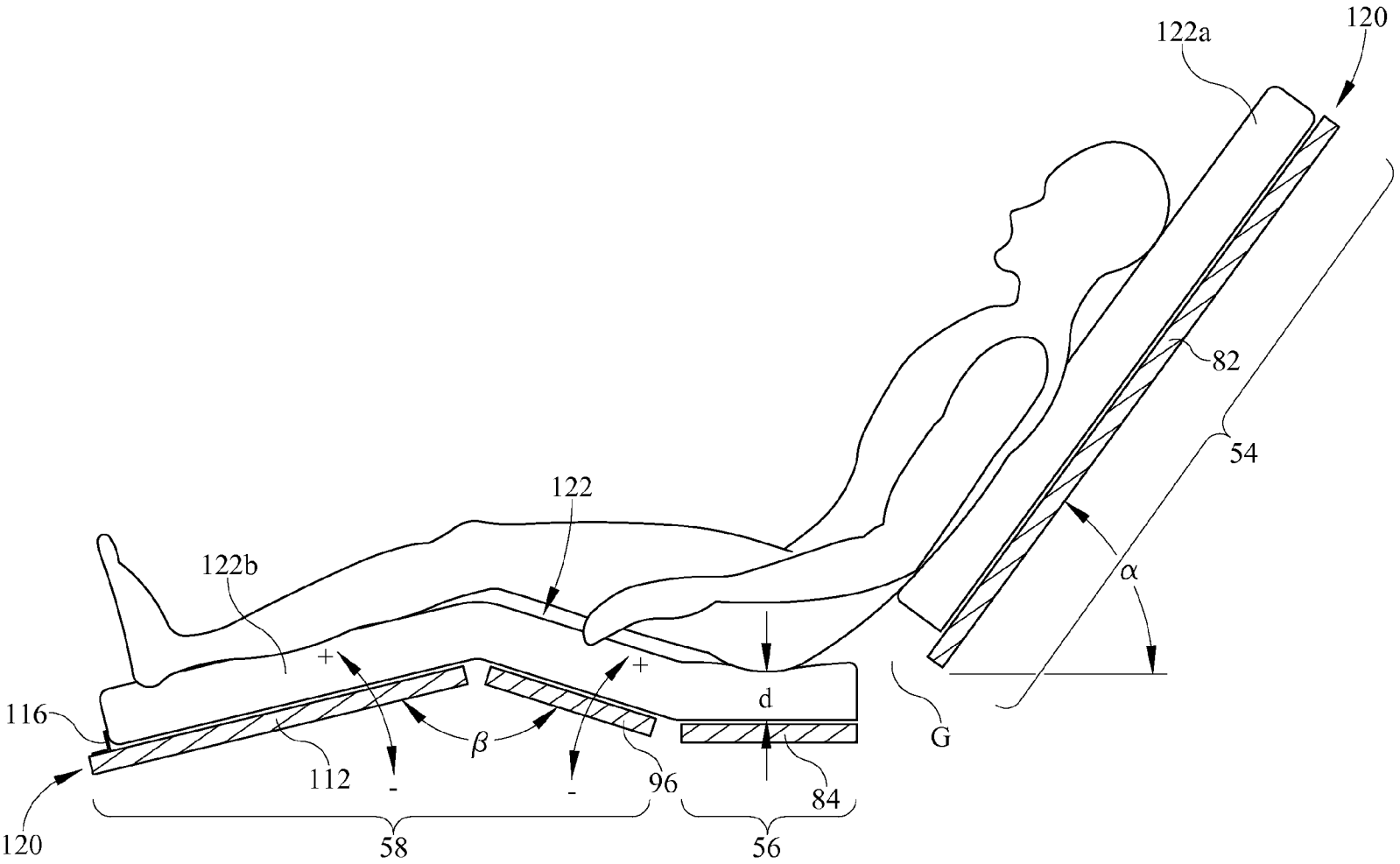
FIG. 2 is a schematic, side elevation view showing a mattress on the bed of FIGS. 1A and 1B.

As is evident in FIG. 2, positive rotation of the upper body section 54 may open a gap G between mattress units 122*a* and 122*b*. If the seat section 56 is present, it may be advantageous to translate the seat section vertically while the upper body section 54 is pivoting in order to help fill the gap.

The leg section 58 need not be articulable, especially if a motion control system capable of delivering occupant customized amounts of $\Delta B_S$ and $\Delta C_S$ is used. However the absence of leg section translatability will introduce anthropometric compromises (in a fixed $\Delta B_S/\Delta C_S$ ratio system) and the inability to adjust the angle β will compromise the ability to enhance occupant comfort and provide heel pressure relief.

The calf section 62 could also be constructed with a calf deck panel similar to the upper body deck panel 82 and able to undergo a similar parallel translation.

Figure 13:
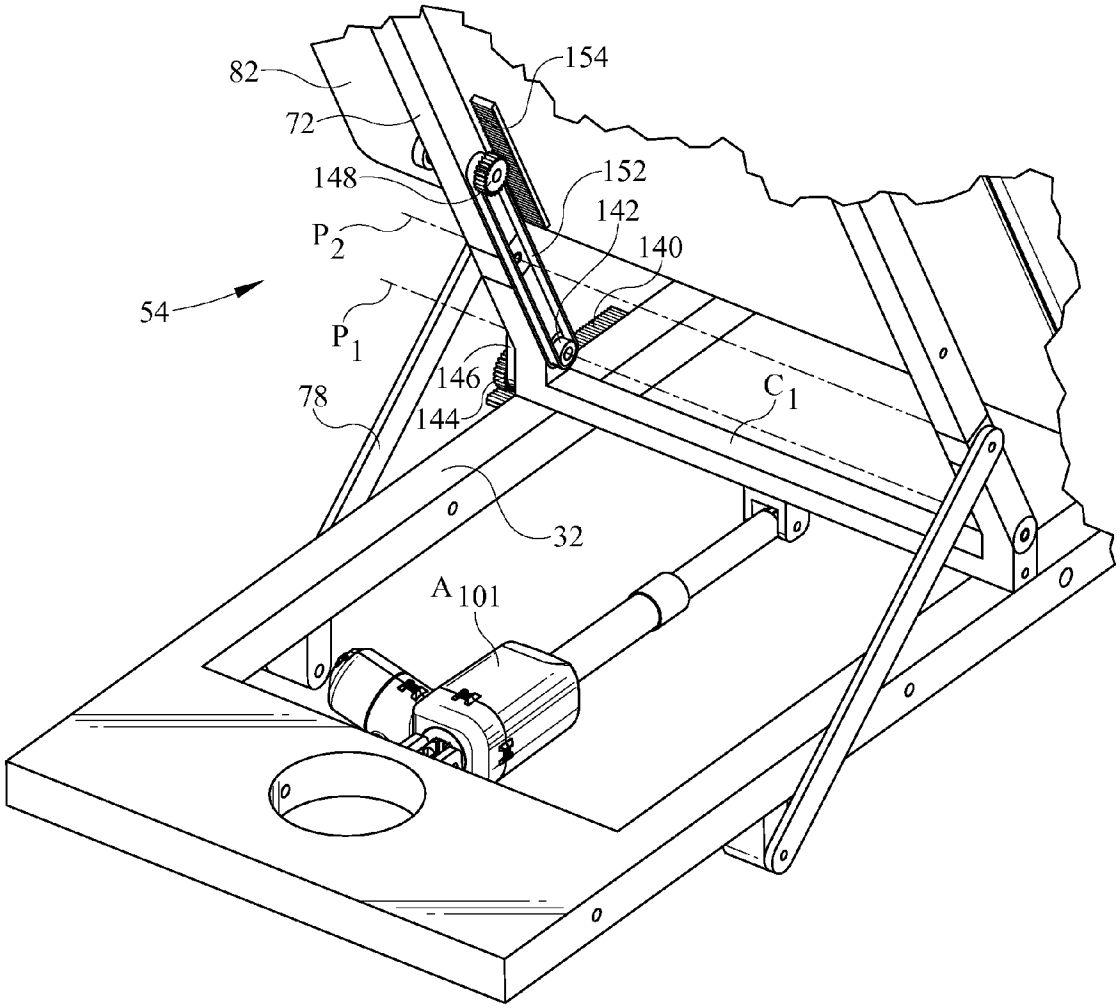
FIG. 13 is a perspective view of an articulating bed similar to that of FIGS. 1A and 1B but with certain changes to the kinematic elements.

The reader should also appreciate that many kinematic arrangements other than as described herein may be used and may be more commercially attractive. For example, the illustrated bed includes three actuators A1, A2, A3 for controlling motions of the upper body frame. The multiple actuators are desirable in a prototype or experimental bed to allow maximum flexibility of articulation during testing and development. However it is envisioned that beds produced for commercial sale will include fewer actuators for the upper body section. For example, as seen in FIG. 13, the upper frame 32 includes a frame rack 140. An actuator A101 extends between the upper frame 32 and carriage C1. Carriage C1 includes a pulley 142 that extends through beam 72 at pivot axis P1 and a pinion 144 engaged with rack 140. A laterally outer belt 146 connects the outboard end of pulley 142 to a pulley portion (not visible) of the pinion. The lateral rail 72 also includes a drive gear 148. A laterally inner belt 152 connects the inboard end of pulley 142 to a pulley portion of the drive gear. The upper body deck panel 82 includes a deck rack 154 that meshes with the drive gear. In operation the actuator extends or retracts to translate the carriage, and therefore the entire upper body section 54. The translation causes the upper body section to pivot about axis P1. Concurrently, the relative motion between the rack 140 and pinion 144 is conveyed to the deck rack 154 by way of the belts 146, 152, and drive gear 148.

The mattress 122 illustrated in FIG. 2 includes two distinct mattress units, an upper body unit 122*a* substantially longitudinally coextensive with the upper body section 54, and a lower body unit 122*b* substantially longitudinally coextensive with the seat section 56 (if present) and the leg section 58. More than two mattress units may instead be used, and the number of such units need not equal the number of articulable sections. A single unit mattress extending substantially the entire longitudinal length of the bed may not offer the required degree of longitudinal elasticity unless it has a small thickness t.

The mattress may be an inflatable mattress, a non-inflatable mattress or may have both inflatable and non-inflatable components.

The relationship of equation (1) for determining $\Delta B_S$ presupposes the use of a mattress of known thickness and elasticity. However the use of alternative mattresses having different properties can also be accommodated. For example, a user interface device can include provisions for indicating which of two or more candidate mattresses having known properties is being used (e.g. the user would select between the model 2000, 2200 and 2500 mattresses). The processor's memory would include mattress specific adjustments (e.g. to the relationships of FIG. 6, or to similar, mattress-independent relationships or to equation (1)) Another alternative envisions providing a user interface device that allows direct entry of a mattress thickness, elasticity and other relevant properties for use in adjusting the relationship.

Although this disclosure refers to specific embodiments, it will be understood by those skilled in the art that various changes in form and detail may be made without departing from the subject matter set forth in the accompanying claims.

We claim:

1. An occupant support system for supporting an occupant, the support system comprising:

a frame;

an articulable assembly comprising an upper body section; and a motion control system configured to substantially simultaneously (i) rotate the upper body section about an axis by an amount Δα relative to the frame from a lowered position generally parallel to the frame to a raised position, (ii) translate the upper body section along the frame by an amount ΔCS, and (iii) translate a panel of the upper body section by an amount ΔBS in a direction upwardly away from the frame and parallel to left and right rails of the upper body section, both ΔBS and ΔCS increasing as Δα increases, wherein the panel is at a fixed position and cannot be moved relative to the left and right rails when the upper body section is stationary in the lowered position.

2. The support system of claim 1 wherein the articulable assembly comprises a leg section which is translatable by the motion control system.

3. The support system of claim 2 wherein the upper body section and the leg section are the only sections of the articulable assembly that are moved by the motion control system.

4. The support system of claim 1 wherein the frame has a head end and a foot end spaced apart longitudinally from the head end, and further comprising a translatable seat section longitudinally footwardly of the upper body section, motion of the seat section being ungoverned by the motion control system.

5. The support system of claim 1 wherein the motion control system moves the articulable assembly based on a single occupant non-specific relationship relating the motion of the articulable assembly to anthropometric information representative of a target population of occupants.

6. The support system of claim 1 wherein the motion control system moves the articulable assembly based on multiple, occupant specific relationships relating the motion of the articulable assembly to occupant anthropometric characteristics.

7. The support system of claim 6 wherein the anthropometric characteristics are determined from occupant gender, height and weight.

8. The support system of claim 6 wherein the anthropometric characteristics include at least dimensions $B_{ANTHRO\text{-}FEMALE}$, $C_{ANTHRO\text{-}FEMALE}$, $B_{ANTHRO\text{-}MALE}$, and $C_{ANTHRO\text{-}MALE}$.

9. The support system of claim 8 wherein $B_{ANTHRO\text{-}FEMALE}$, $C_{ANTHRO\text{-}FEMALE}$, $B_{ANTHRO\text{-}MALE}$, and $C_{ANTHRO\text{-}MALE}$ are determined from a linear relationship to occupant weight/height ratio.

10. The support system of claim 6 wherein the occupant anthropometric characteristics are determined at least in part from a bed on-board system.

11. The support system of claim 1 wherein the frame has a head end and a foot end spaced apart longitudinally from the head end, and wherein:

the motion control system translates and parallel translates the upper body section headwardly in conjunction with rotating the upper body section in a positive rotational direction, the positive rotational direction being a direction that increases an angle between the upper body section and the frame; and the motion control system translates and parallel translates the upper body section footwardly in conjunction with rotating the upper body section in a negative rotational direction, the negative rotational direction being a direction that decreases the angle between the upper body section and the frame.

12. The support system of claim 1, wherein the frame has a head end and a foot end spaced apart longitudinally from the head end, and further comprising:

a translatable leg section;

wherein the motion control system is configured to:

rotate the upper body section in a positive direction, the positive direction being a direction that increases an angle between the upper body section and the frame;

parallel translate the upper body section headwardly in conjunction with the positive rotation;

translate the upper body section headwardly by the amount ΔCS in conjunction with the positive rotation; and if the distance ΔCS is less than a desired distance by an amount h, translate the leg section footwardly by the amount h.

13. The support system of claim 1, wherein the frame has a head end and a foot end spaced apart longitudinally from the head end, and further comprising:

a translatable leg section;

wherein the motion control system is configured to:

rotate the upper body section in a positive direction, the positive direction being a direction that increases an angle between the upper body section and the frame;

parallel translate the upper body section headwardly in conjunction with the positive rotation;

translate the upper body section headwardly by the amount ΔCS in conjunction with the positive rotation; and if the distance ΔCS is more than a desired distance by an amount k, translate the leg section headwardly by the amount k.

14. The support system of claim 1, wherein the frame has a head end and a foot end spaced apart longitudinally from the head end, and further comprising:

a translatable leg section;

wherein the motion control system is configured to:

rotate the upper body section in a positive direction, the positive direction being a direction that increases an angle between the upper body section and the frame;

parallel translate the upper body section headwardly in conjunction with the positive rotation;

translate the upper body section headwardly by the amount ΔCS in conjunction with the positive rotation and if ΔCS is less than a desired distance by an amount h, translate the leg section footwardly by the amount h; and if ΔCS is more than the desired distance by an amount k, translate the leg section headwardly by the amount k.

* * * * *